US005832996A

United States Patent [19]

Carmody et al.

[11] Patent Number: 5,832,996

[45] Date of Patent: Nov. 10, 1998

[54] ELECTRO HYDRAULIC DOWNHOLE CONTROL DEVICE

[75] Inventors: Michael A. Carmody, Houston; Kevin R. Jones, Humble; Robert J. Coon, Houston; Douglas J. Murray, Humble; Mark E. Hopmann, Alvin; Steven L. Jennings, Friendswood, all of Tex.

[73] Assignee: Baker Hughes Incorporated, Houston, Tex.

[21] Appl. No.: 799,257

[22] Filed: Feb. 14, 1997

Related U.S. Application Data

[60] Provisional application No. 60/015,375, Feb. 15, 1996.

[51] Int. Cl.[6] ..... E21B 43/12; E21B 47/00

[52] U.S. Cl. ..... 166/53; 137/625.48; 137/625.68; 166/66.6; 166/66.7

[58] Field of Search ..... 166/53, 66.6, 66.7; 137/625.48, 625.68

[56] References Cited

U.S. PATENT DOCUMENTS

| | | | |
|---|---|---|---|
| 3,195,559 | 7/1965 | Stacey | 137/625.68 X |
| 3,221,770 | 12/1965 | Faisandier | 137/625.68 X |
| 3,252,482 | 5/1966 | Kumm | 13/625.48 |
| 4,161,215 | 7/1979 | Bourne, Jr. et al. | 166/53 X |
| 4,375,239 | 3/1983 | Barrington et al. | 166/336 |
| 4,649,993 | 3/1987 | Going, III | 166/66.6 |
| 4,787,446 | 11/1988 | Howell et al. | 166/66.6 |
| 4,896,722 | 1/1990 | Upchurch | 166/53 X |
| 5,127,477 | 7/1992 | Schultz | 166/336 |
| 5,355,960 | 10/1994 | Schultz et al. | 166/53 X |

FOREIGN PATENT DOCUMENTS

| | | |
|---|---|---|
| 0 604 155 A1 | 6/1994 | European Pat. Off. . |
| 2 081 776 | 2/1982 | United Kingdom . |

*Primary Examiner*—George Suchfield

*Attorney, Agent, or Firm*—Fishman, Dionne, Cantor & Colburn

[57] ABSTRACT

A downhole controller for a flow control device. The controller is responsive to commands from the surface or from downhole and controls the flow device using a four way solenoid actuated spool valve and a hydraulically actuated piston system connected to the flow control device.

18 Claims, 15 Drawing Sheets

3
70

5

ELECTRO HYDRAULIC DOWNHOLE CONTROL DEVICE

This application claims the benefit of an earlier filing date from Provisional Application Ser. No. 60/015,375, filed Feb. 15, 1996.

BACK GROUND OF INVENTION

1. Field of the Invention

The invention relates to regulating flow of any given production zone into the production tube. More particularly, the invention relates to selective actuation of a flow control device.

2. Prior Art

As one of skill in the art will readily recognize, flow control devices such as the CM sliding sleeve, commercially available from Baker Oil Tools, 6023 Navigation Boulevard, Houston, Tex. 77011, have been known to the industry and depended upon thereby for a number of years. The tool is very effective but does require that a shifting tool be run to open or close the CM sliding sleeve. Running a shifting tool is time consuming and incurs the characteristic six figure cost associated with any tool run. Moreover, it is sometimes desired to change the positions of the closing sleeve or insert relative to the sleeve housing in metered increments thereby enabling a closer control over the flow device; doing the same through the employment of a shifting tool is extremely difficult. Several miles of wireline, coil tubing, etc., to move in order to actuate the tool makes small position changes nearly impossible.

Due to advancements in downhole electronic actuators and sensors as well as sophisticated decision making electronics which may be either at the surface or downhole such as that disclosed in U.S. Ser. No. 08/385,992 filed Feb. 9, 1995, now U.S. Pat. No. 5,732,776 by Baker Oil Tools and incorporated herein by reference, improved control apparati are more feasible.

SUMMARY OF THE INVENTION

The above-discussed and other drawbacks and deficiencies of the prior art are overcome or alleviated by the electro/hydraulic actuation of the present invention. At least one piston is mounted within a chamber, which piston bifurcates the chamber into two piston chambers. The piston is connected to an otherwise conventional flow control device and upon pressurization of one of the piston chambers and release of pressure on the other thereof the flow control device is actuated as desired. The invention provides a spool valve having the ability to selectively channel pressurized fluid to a down stroke piston chamber or to an upstroke piston chamber while concurrently allowing pressure to bleed off the other of the two piston chambers. Pressure on the upstroke side of the piston closes the sleeve and pressure on the downstroke side of the piston opens the sleeve. As stated and in order to render selected movement easier, pressure is allowed to bleed off from the piston not being biased. The bled fluid tracks back through the supply line to that piston chamber and through the spool valve to a predetermined dump site. The location of the dump site depends upon whether or not the embodiment being considered is a closed or open loop system.

Two unique embodiments are primarily contemplated herein although it will be understood that modifications are within the scope and spirit of the invention.

In the first preferred embodiment, the closed loop system, a downhole reservoir, pump and accumulator are provided such that the entire system is closed and is operable entirely downhole. Fluid is drawn from the reservoir into the pump which conveys the fluid to the accumulator under increasing pressure the accumulator releases fluid to the spool valve which directs the same to the desired piston chamber and also shunts fluid from the other piston chamber back to the reservoir.

In the second embodiment the reservoir, pump and accumulator are eliminated downhole and a TEC wire and a hydraulic fluid line are strung from the surface down to the spool valve which actuates the tool as discussed. Bled off fluid is dumped either into the production tube or into the well annulus. It will be appreciated that dumping the fluid to the annulus is preferable in most circumstances because pressure in the production tube is higher, thus requiring higher fluid pressures in the selected piston chamber to overcome the pressure acting on the other chamber from the fluid dump area.

The invention provides a significant advance to the industry in both of control of flow downhole in general and in micromanaging the same.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
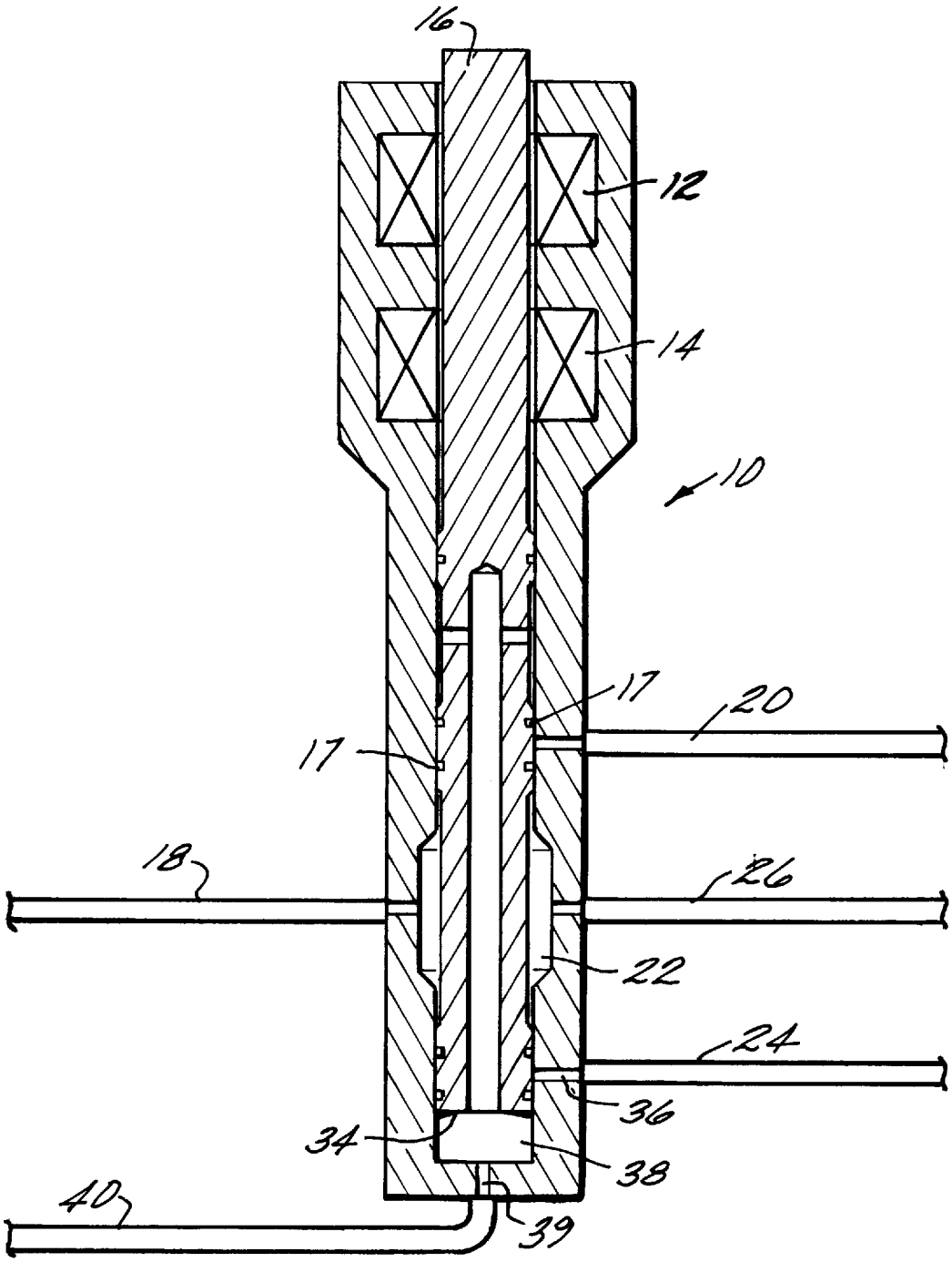
FIG. 1 is a schematic transverse section of the spool valve of the invention wherein the open and close lines are isolated.
Figure 2:
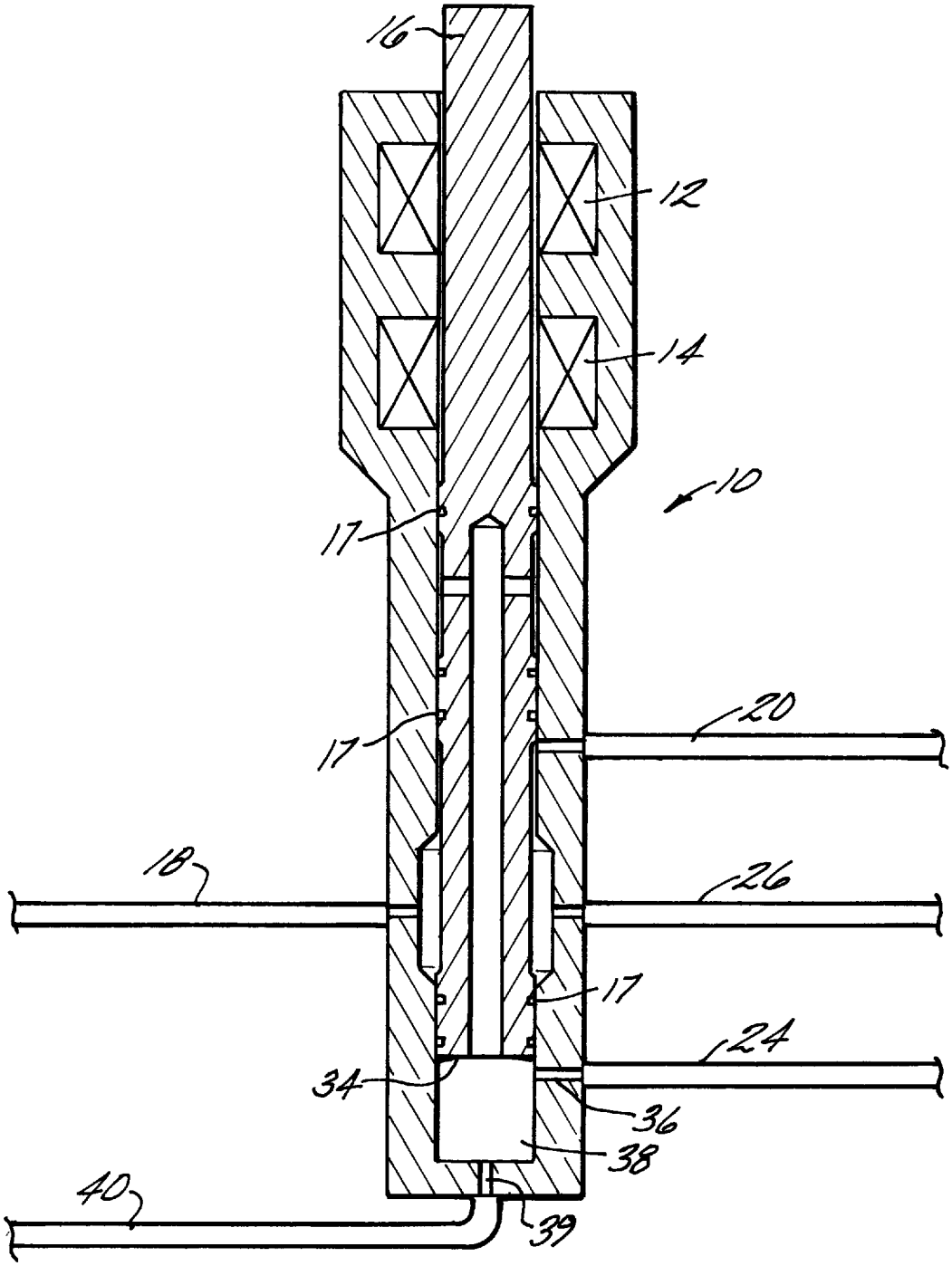
FIG. 2 is a schematic transverse section of the spool valve of the invention wherein the open line is activated and close line is in the bleed position.
Figure 3:
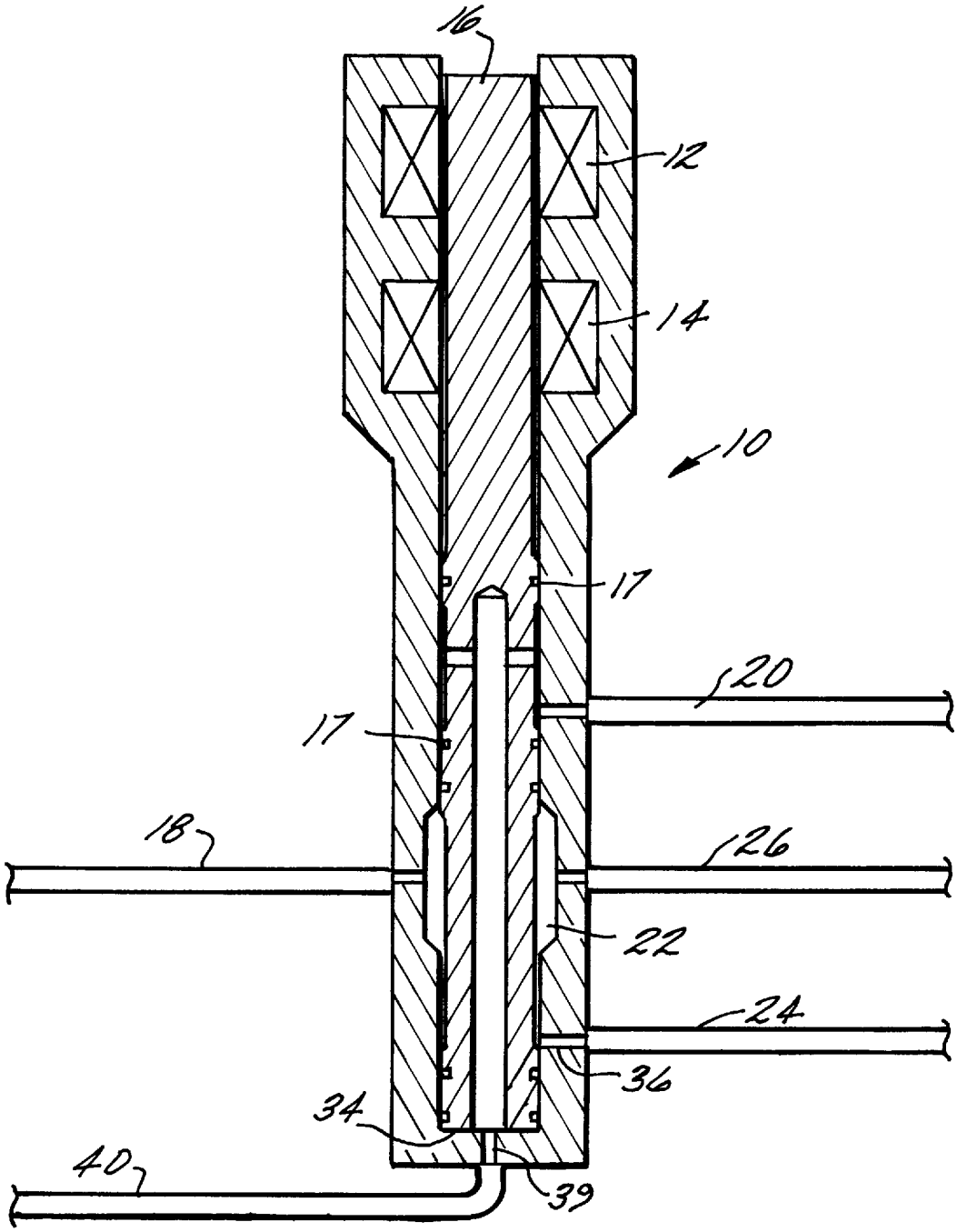
FIG. 3 is a schematic transverse section of the spool valve of the invention wherein the open line is in the bleed position and the close line is in the activated position.

Referring to the open loop system first as illustrated in FIGS. 1–5, hydraulic fluid is supplied from the surface through hydraulic inlet 18. Power to the solenoid operated spool valve 10 is also from the surface or from a power source uphole from the valve 10 and is comprised preferably of ¼ TEC O.D. wire which is a power conduit disposed within a steel sleeve and isolated therefrom by epoxy material. The solenoid operated spool valve 10 includes at least one winding but preferably two windings. Most preferred is a sleeve open winding 12 and a sleeve close winding 14. These are energized selectively to move armature 16 in a desired direction. When armature 16 is in the neutral position as in FIG. 1, neither the open nor close lines are pressurized to move the sleeve. Fluid merely travels through spool valve 10 to the next arrangement through hydraulic outlet 26. A benefit of the closing off of both the open line 20 and the close line 24 is that whatever pressure is in the piston chambers when the spool valve armature 16 is returned to neutral, is trapped in the respective chamber thus locking the sleeve in place. As is illustrated in FIG. 2, having the armature uphole (or in the sleeve open position) connects the hydraulic fluid inlet 18 to the hydraulic sleeve open line 20 through annular fluid path 22; moving the armature downward connects inlet 18 to hydraulic sleeve close line 24 through annular fluid path 22 (FIG. 3). Hydraulic outlet 26 remains connected to the annular path 22 regardless of the position of the armature 16 to ensure that fluid continues to the next sleeve arrangement.

As stated hereinbefore, it is advantageous to provide for the bleeding off of fluid from the piston chamber not being pressurized. As the selected piston chamber is pressurized, e.g., piston chamber 30 illustrated in FIG. 4, the other chamber, 32 (FIGS. 4 and 5) in this example, will be compressed and will thus expel fluid back through its supply line, in this example, line 24. FIG. 2 illustrates that when armature 16 is positioned to pressurize line 20, armature base 34 is uphole of port 36 which feeds line 24. Thus, fluid previously trapped in chamber 32 will be able to pass through bleed chamber 38 into bleed off line 40 which is connected to bleed chamber 38 through port 39. Conversely and as shown in FIG. 3, when the armature is in the downhole, sleeve close position and is thus allowing pressurized hydraulic fluid to flow through annular fluid path 22 to line 24 through port 36, a bleed annulus 46 is moved into fluid communication with through port 42 of line 20. This allows fluid from chamber 30 to flow back through line 20, through port 42, through bleed annulus 46 and port 44 into central bleed line 48 which with the armature 16 in the position of FIG. 3, is connected to through port 39 enabling fluid flowing as indicated to exit spool valve 10 through bleed off line 40. Bleed off line 40 may dump fluid into the production tube or into the annulus around the production tube. The annulus is a preferred dump site due to the lower ambient pressure therein than in the production tube. This allows for a lower pressure input into the selected piston chamber in order to move the piston 50.

When the armature 16 is in the FIG. 1 position, bleed is prevented by the armature 16. Instantly recognizable are the o-rings 17 employed in a conventional way to aid in sealing the system.

Figure 4:
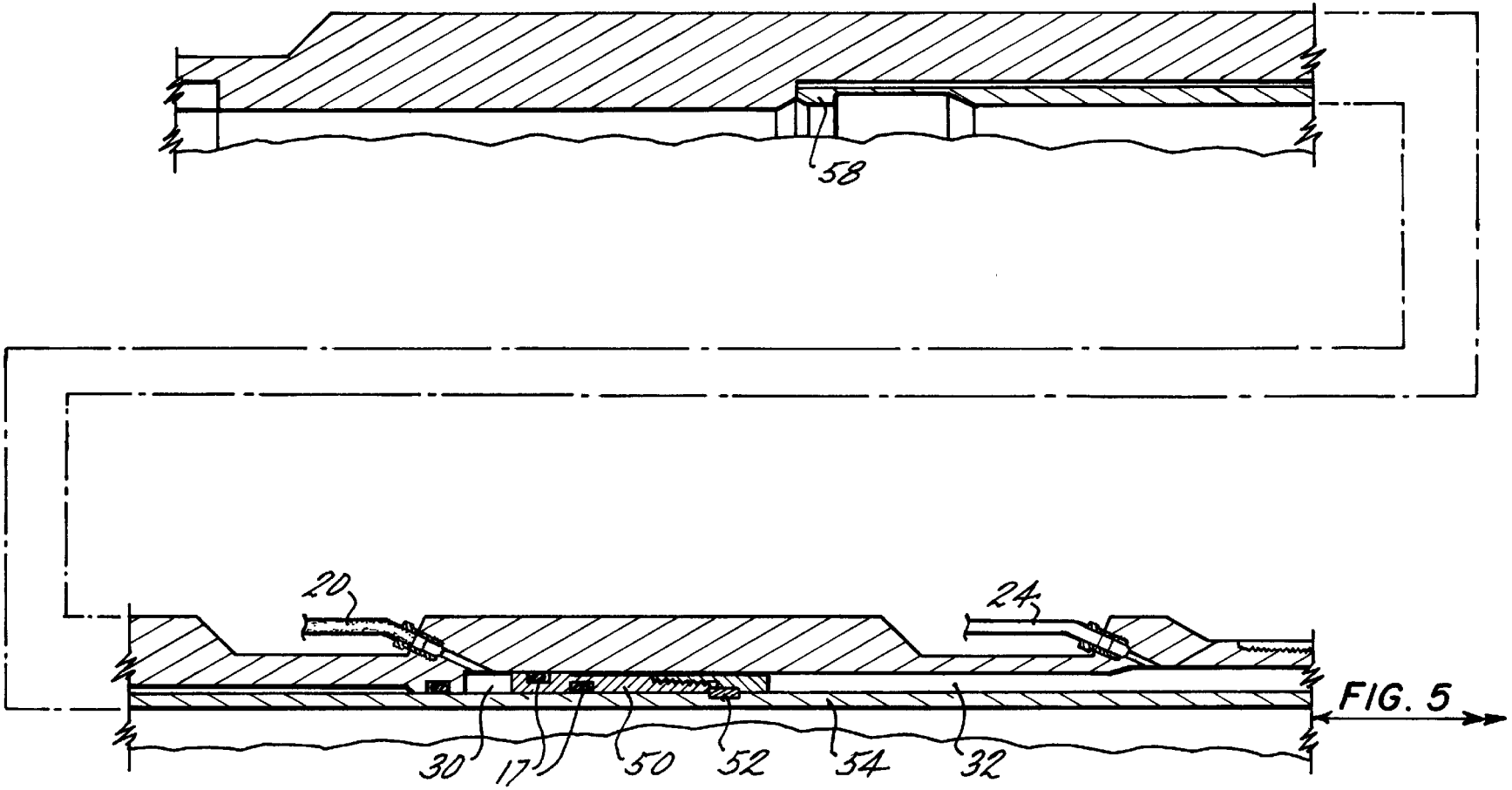
FIGS. 4 and 5 are a schematic transverse section of the piston chambers and open and close lines in the surface pressure open loop embodiment.
Figures 4, 5:
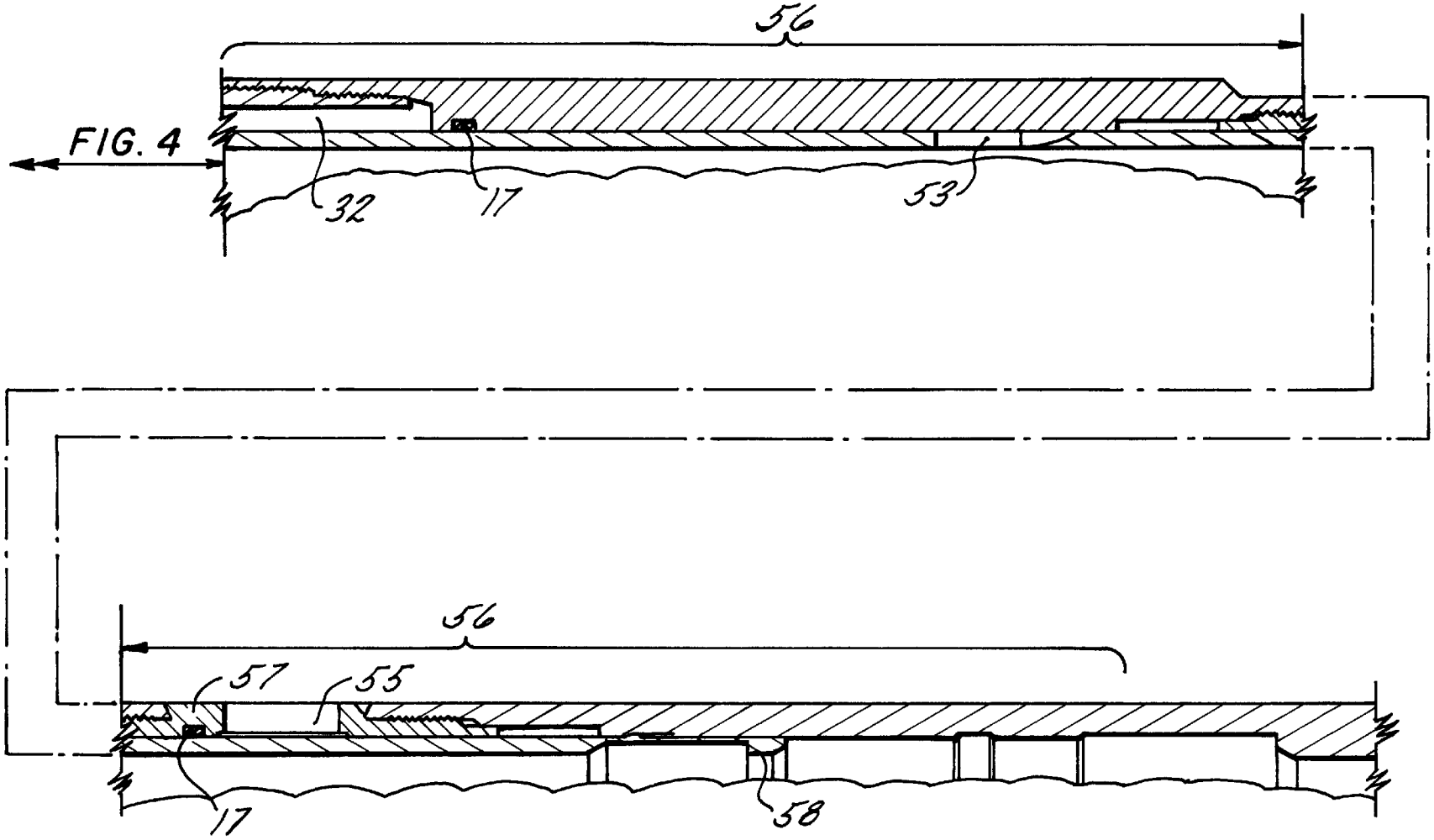
Figure 6:
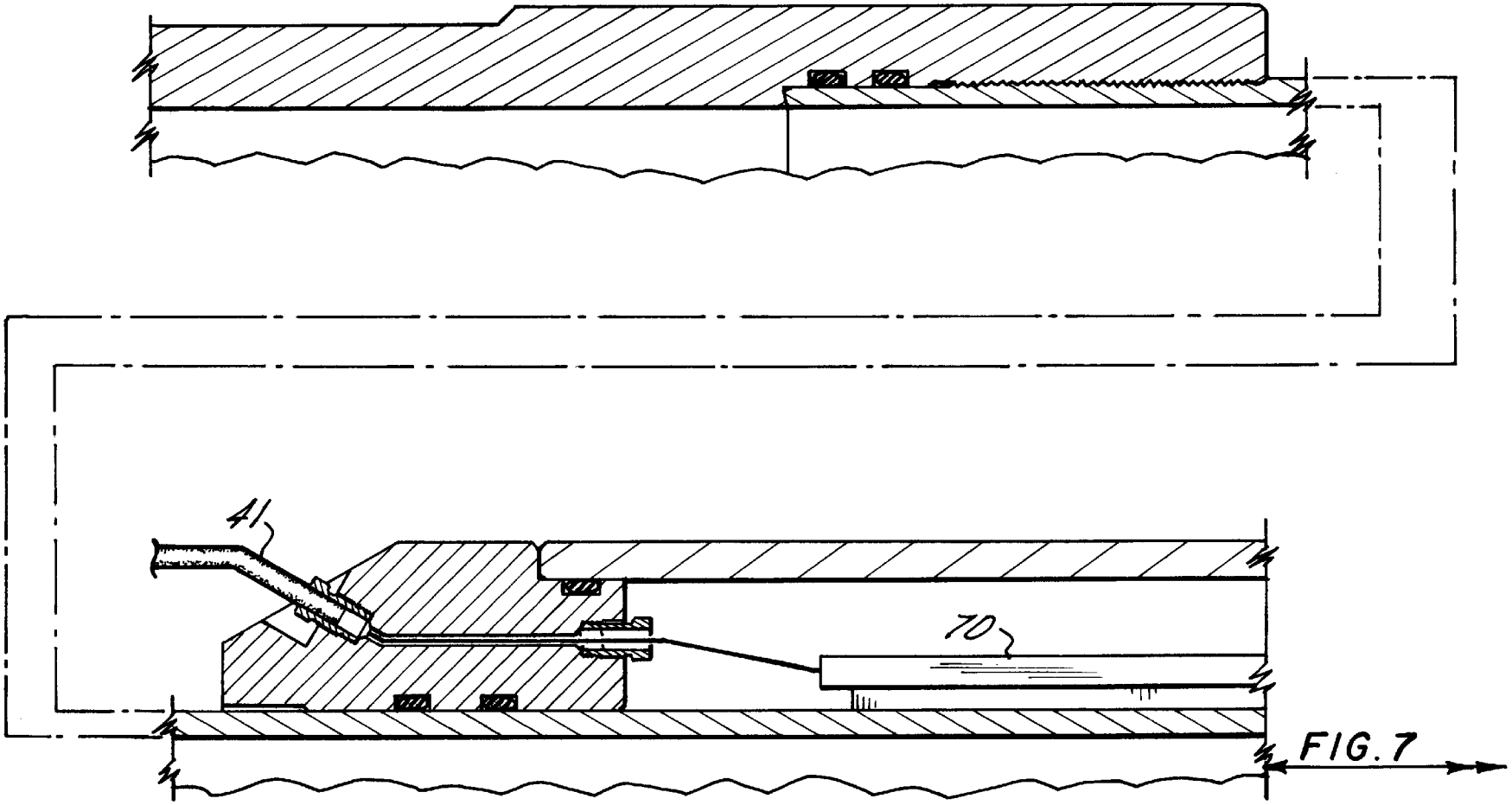
FIGS. 6–14 are transverse views of the closed loop embodiment.
Figures 6, 7, 8:
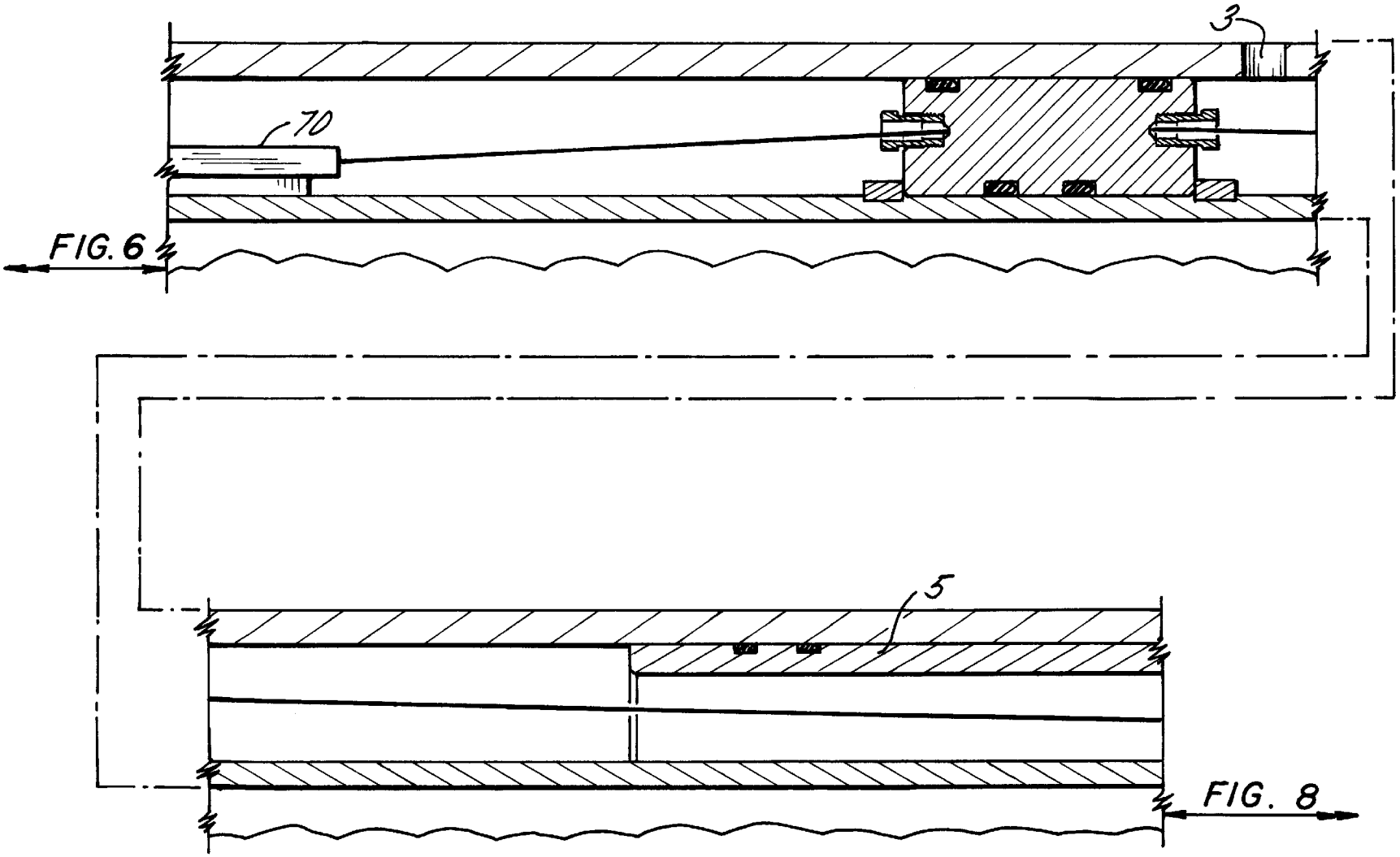
Figure 8:
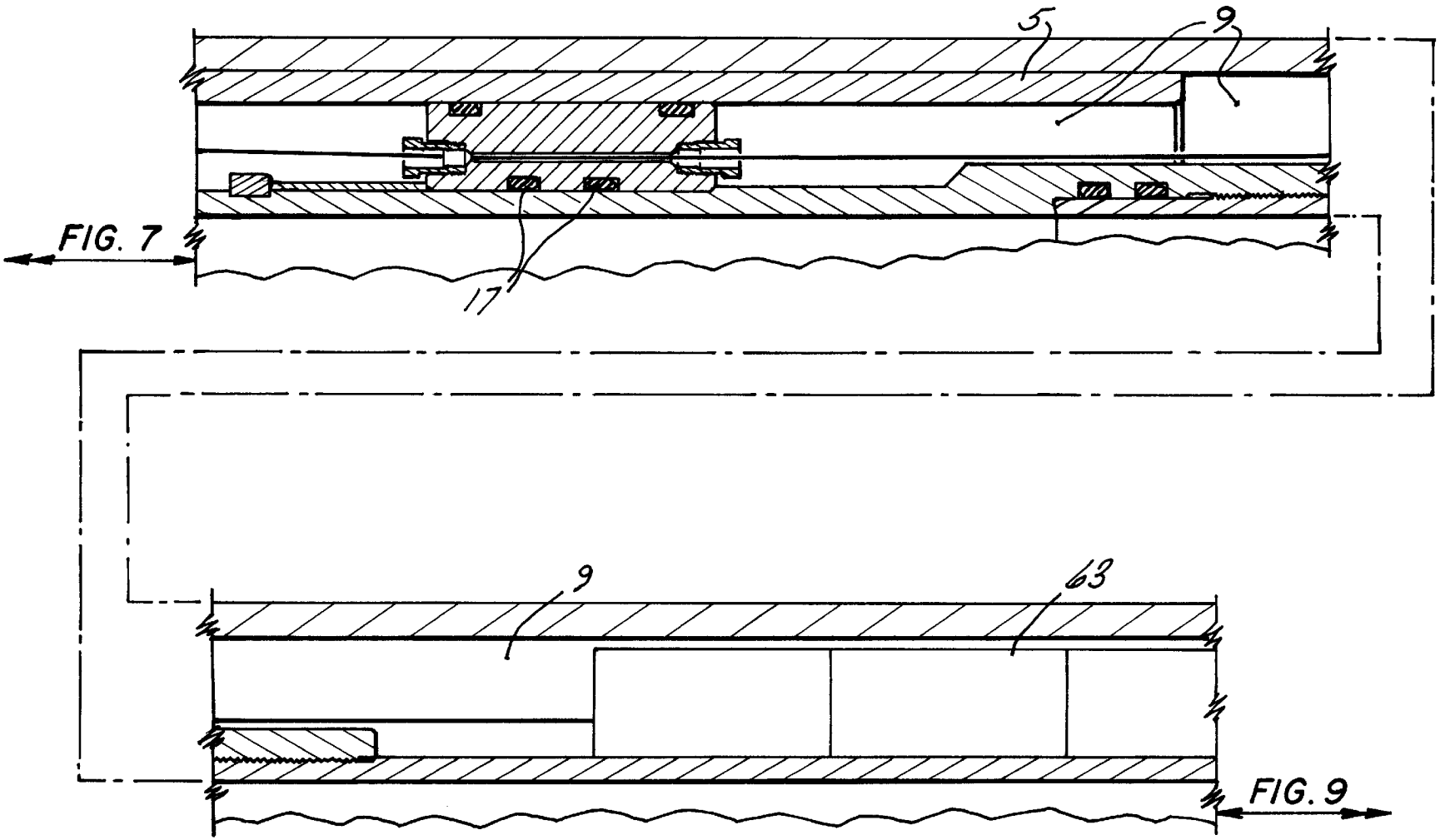

Referring to FIGS. 4 and 5, it will be easily understood by those of skill in the art that piston 50 is slidably disposed between hydraulic fluid chambers 30 and 32 and is connected to insert 54 by a release mechanism which is preferably a shear release and most preferably a shear ring 52 as shown. It will be appreciated that other arrangements are acceptable providing they are capable of operably connecting the piston 50 to the insert 54 of the CM sliding sleeve such that the insert 54 is moved pursuant to pressure applied to one of chamber 30 or 32 while still being capable of facilitating a separation of the insert 54 from piston 50 in the event the solenoid actuated spool valve or connected components fail for some reason. It will be understood that other structures performing the same function are within the scope of the invention. Referring directly to the shear ring embodiment, ring 52 is secured by shear retainer 53 in a conventional way.

In the event of failure, the CM sliding sleeve 56 may be actuated through a conventional wireline or coil tubing process by employing a shifting tool (not shown) on the shifting profiles 58. A load placed on the profile of interest will shear the ring 52 and allow conventional operation of the flow control device. For clarity, 53 refers to the opening in closing sleeve 54 whereas 55 refers to the opening in the housing 57 of CM sliding sleeve 56. Flow is facilitated when 53 and 55 are aligned and choked when these are misaligned.

It is an important aspect of the invention that either fully open/fully closed operations may be preformed or metered open and close operations may be performed as desired.

Figure 15:
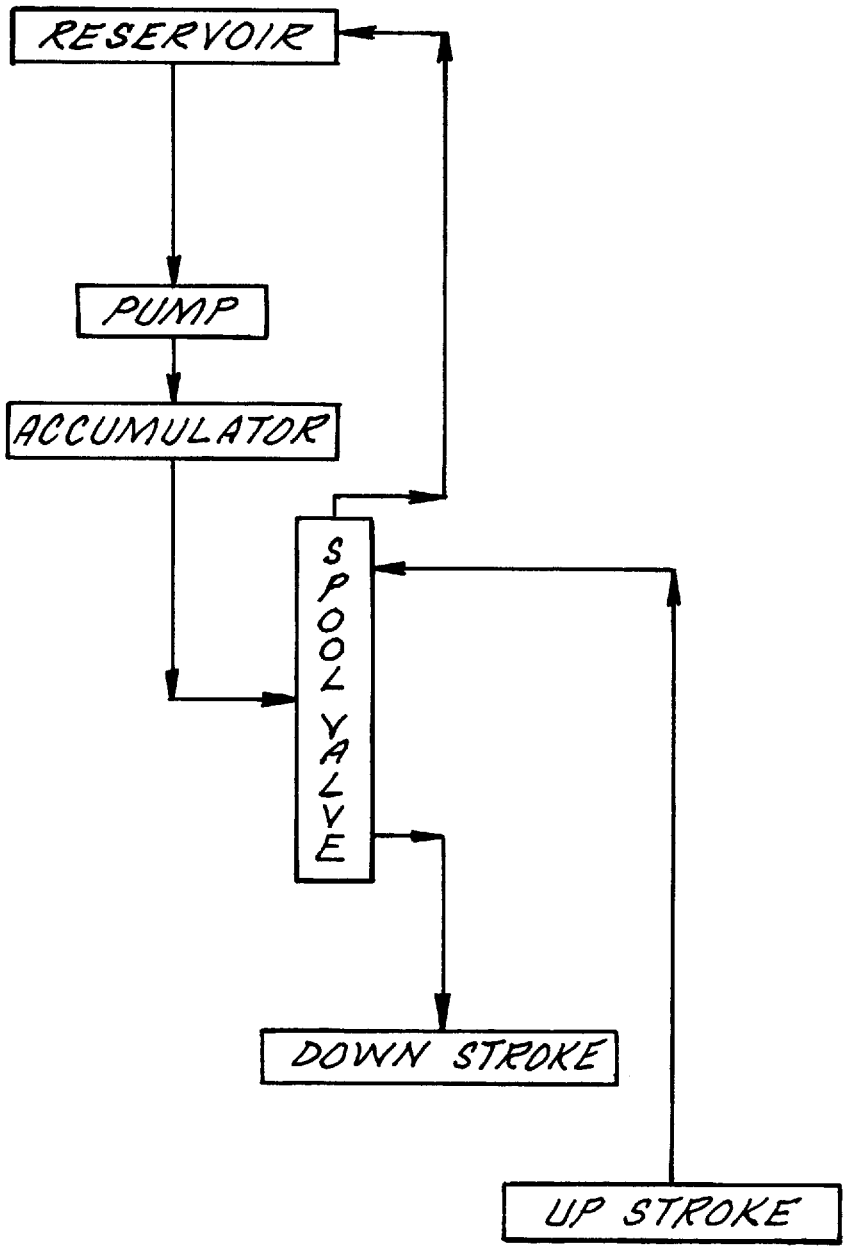
FIG. 15 is a schematic flow chart representation of the closed loop embodiment.

In a second preferred embodiment of the invention, referring to FIGS. 6-14 a completely closed hydraulic fluid system is contemplated. FIG. 15 schematically illustrates fluid line connections. Power for this system may be locally disposed in a nearby atmospheric chamber or remote which includes a surface power source. Whether distant or local, if power is routed outside the housing of the tool then TEC wire 41 is the preferred medium because of the protective quality thereof. As will be appreciated, any wire outside of the housing is subject to being pinched against the casing of the borehole by a substantial amount of weight. TEC wire substantially protects against power failure from these impacts. The closed loop system is similar to the open loop system and will employ identical numerals for identical parts. Moreover, reference is again made to FIGS. 1, 2 and 3 which are equally applicable in this embodiment except that bleed off line 40 leads to a reservoir discussed hereunder as opposed to the production tube or well annulus.

One of the benefits of the closed loop system is that piston chambers 30 and 32 are balanced to allow the operating pressure of the invention to be independent of the well pressure.

Figure 9:
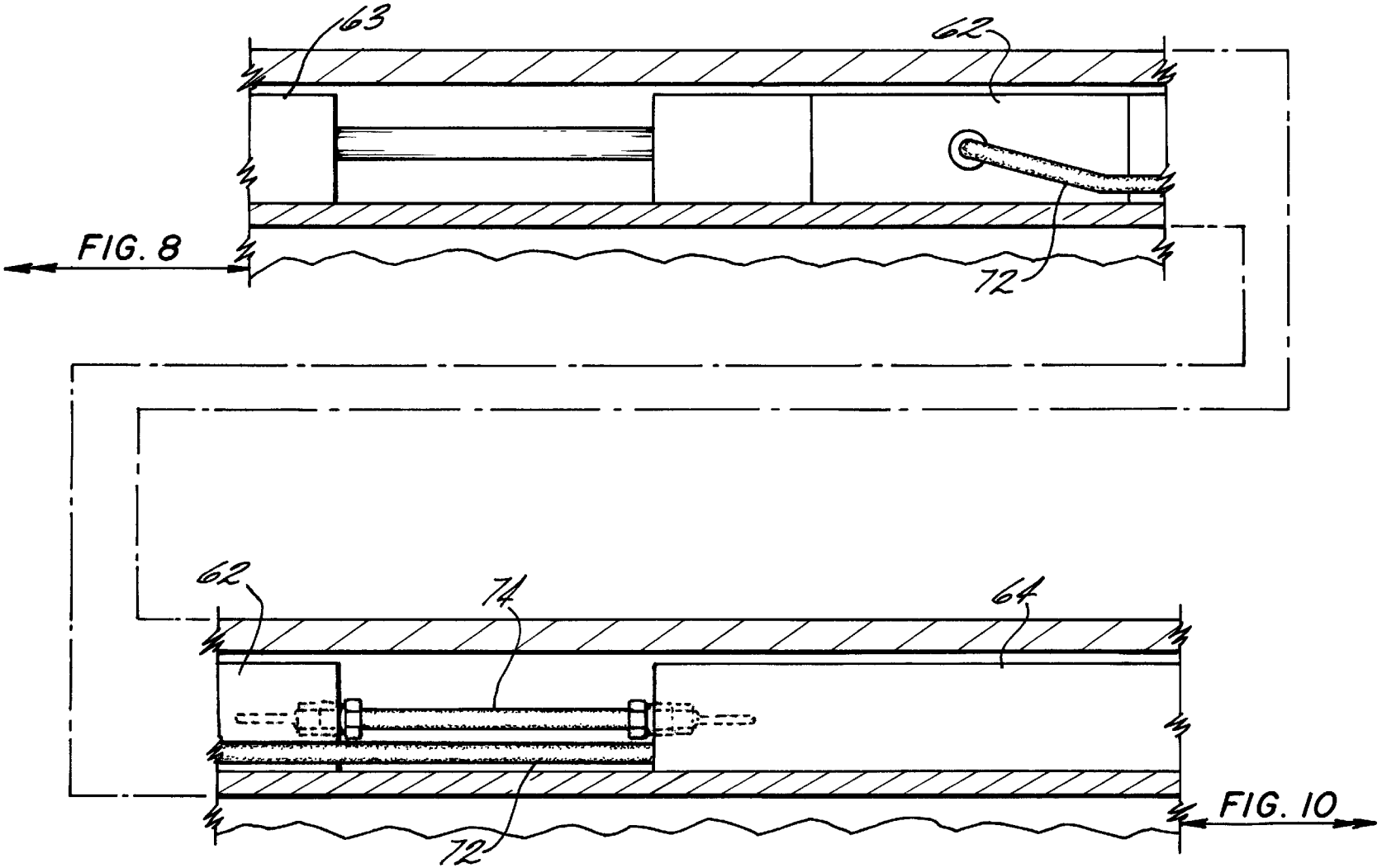
Figure 10:
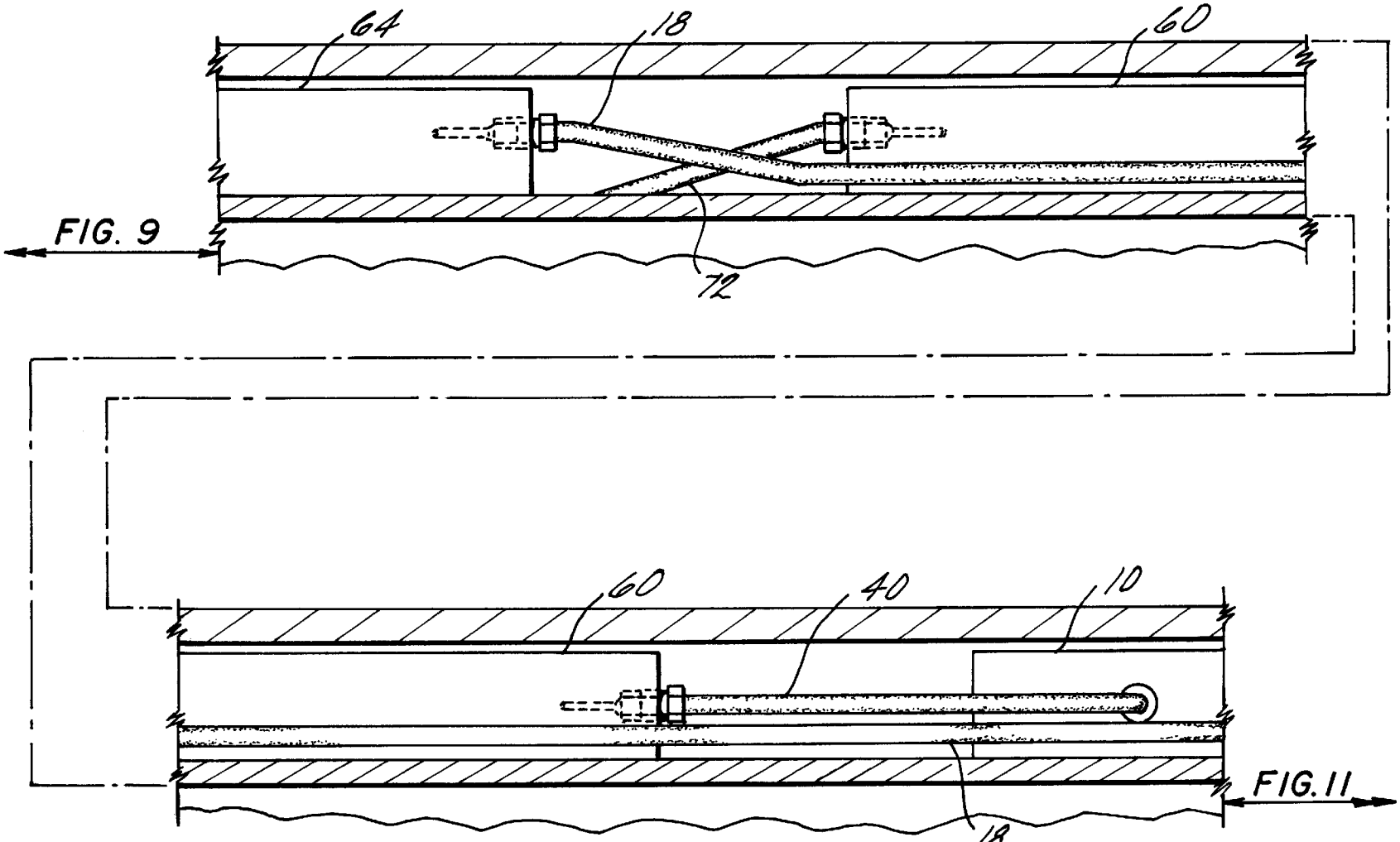
Figure 11:
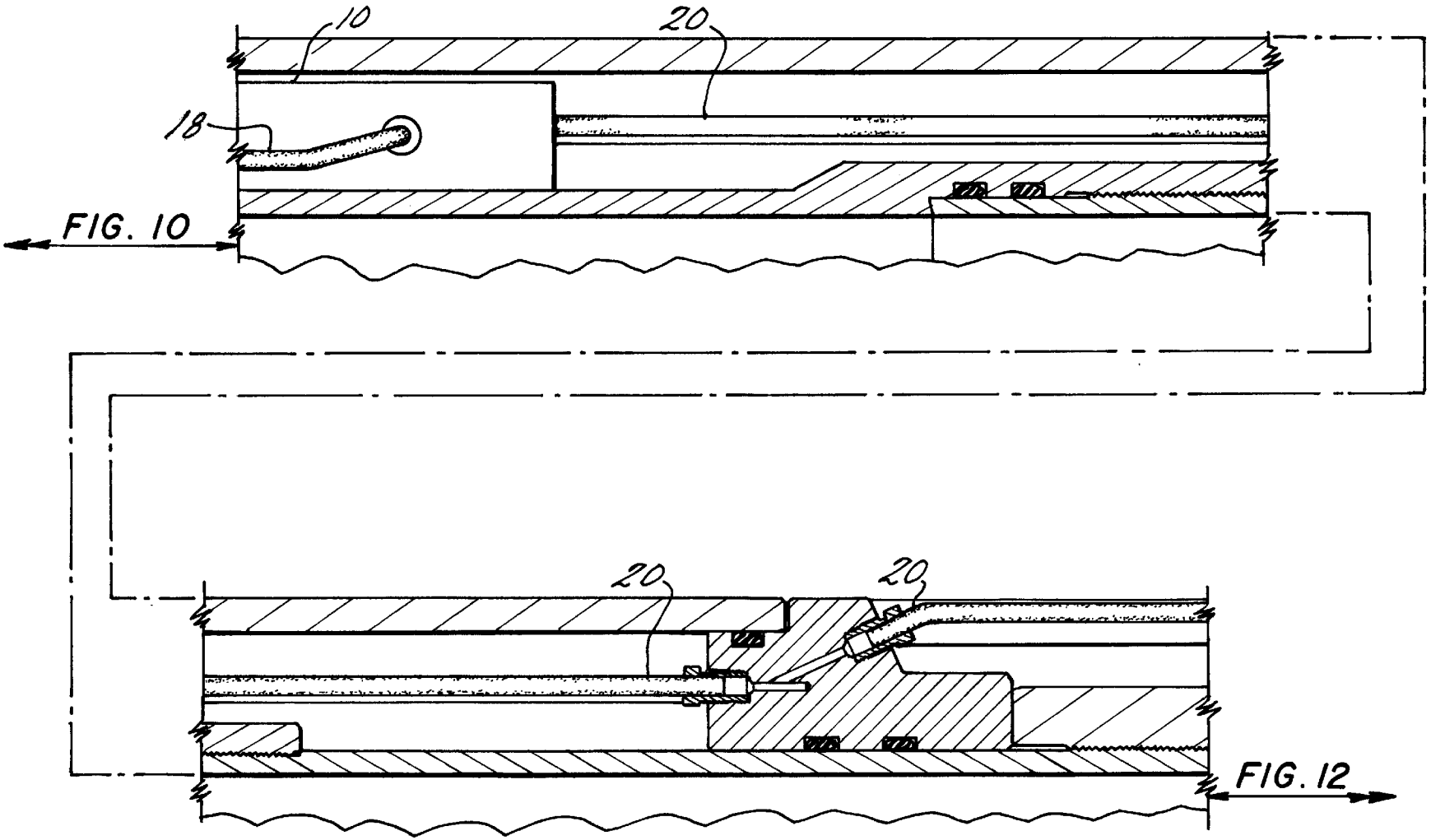
Figure 12:
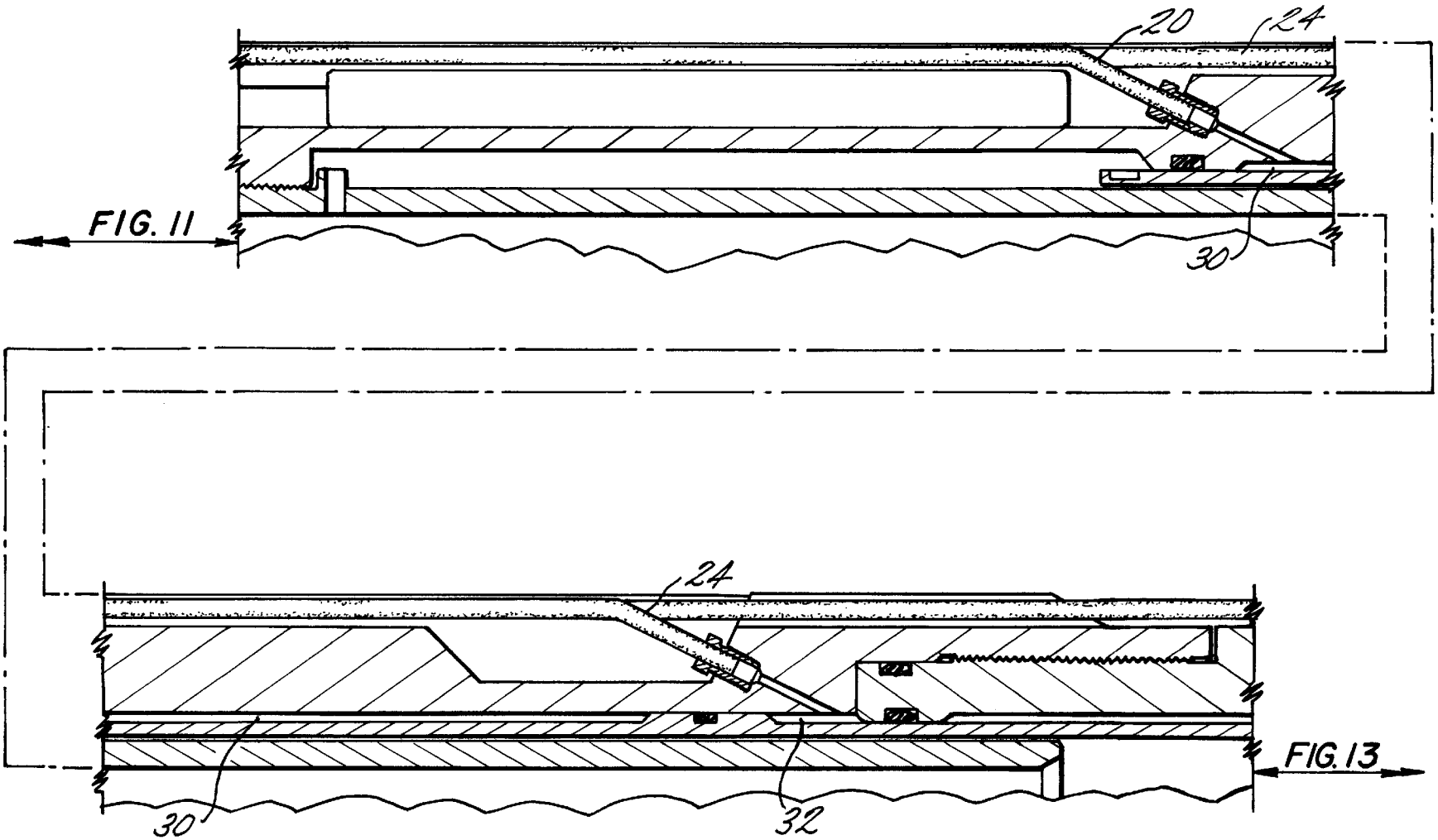
Figure 13:
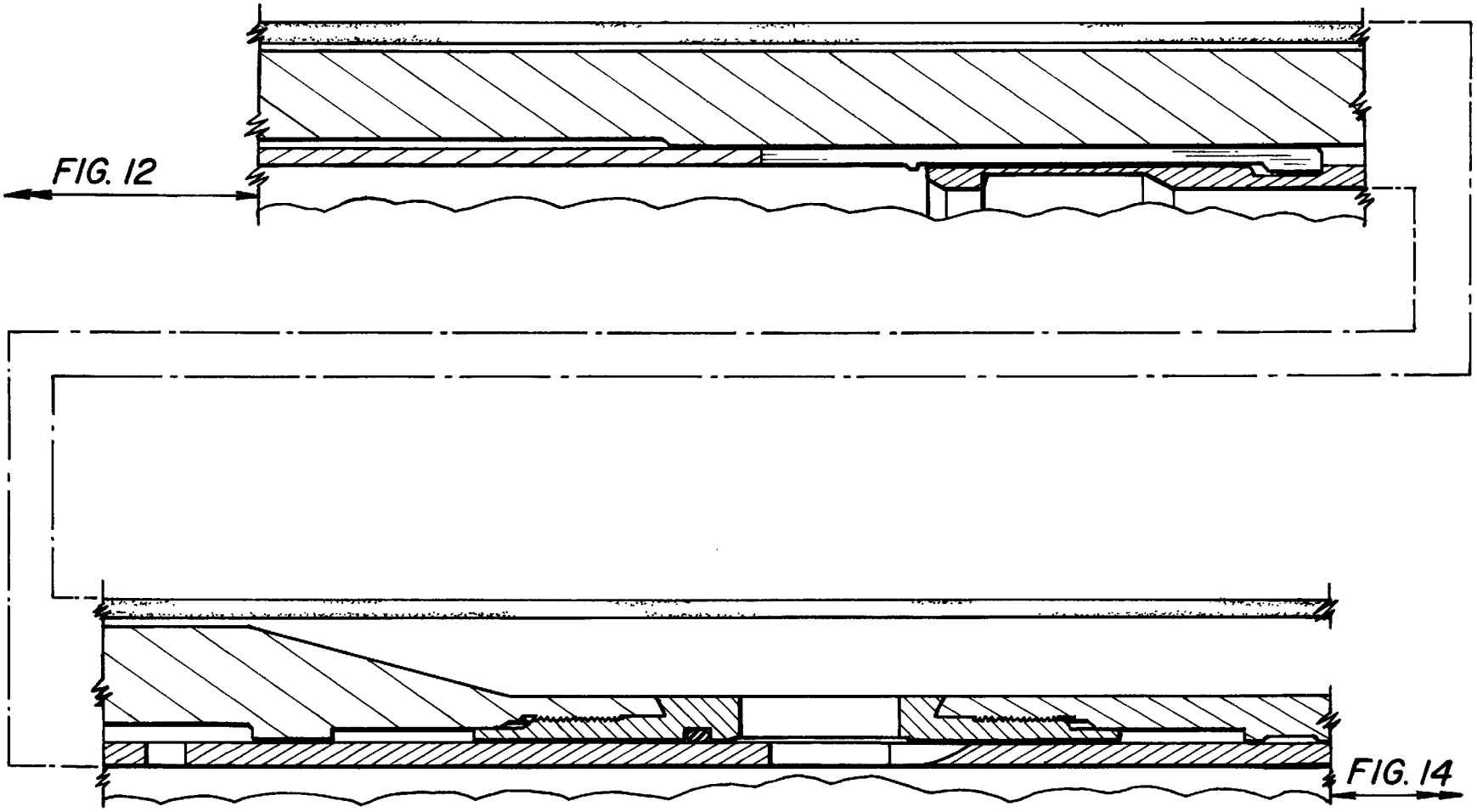
Figure 14:
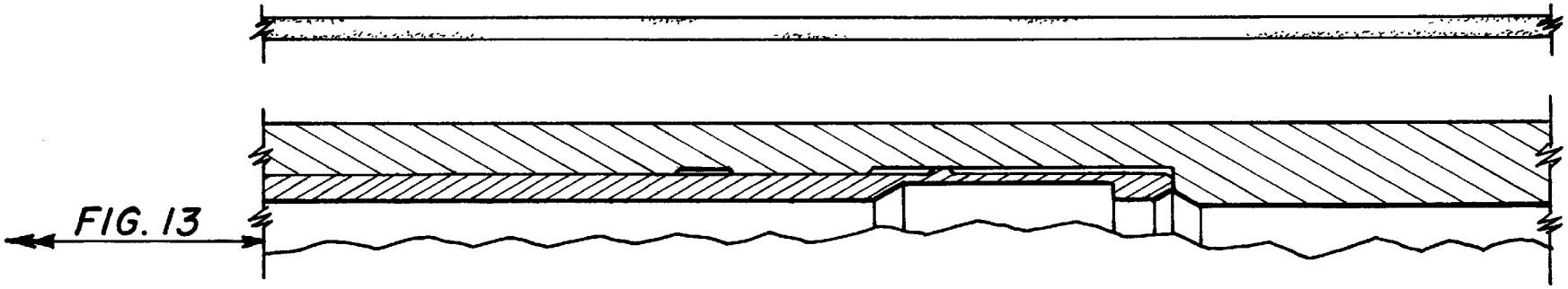

Referring to FIGS. 9 and 10, the additional elements not considered in the previous embodiment are illustrated. These are reservoir 60, section line 72, pump 62, feed line 74 and accumulator 64. Reservoir 60 serves both to supply a hydraulic fluid to pump 62 (which optionally includes motor 63) and to receive bleed off fluid from bleed off line 40. In this embodiment, fluid need not be pressurized from the surface, thus the system requires less hydraulic fluid; from the reservoir 60, fluid need only travel a short distance to the piston chamber to which it is directed, clearly a tremendous volume of fluid is avoided. An issue which is necessary to consider for all downhole closed systems is elevated temperature and pressure and the effects these have on pressure inside the tool. Since the closed loop embodiment of this invention must consider this effect, several solutions are contemplated to construct the device of the invention. The most arduous method for avoiding ruptures due to pressure increase albeit effective involves careful analysis of downhole conditions and careful measurement of the volume of fluid deposited in the tool. The volume deposited will allow for expansion of the fluid under downhole conditions. Other options include bladder type and piston type gas caps. Preferred gas cap embodiments employ nitrogen as the gas. The gas can compress to allow expansion of the fluid thus preventing a rupture.

In the present invention, the most preferred pressure relief arrangement is a piston chamber open to well fluid on one side of a piston and having hydraulic oil on the other side of the piston. As the tool is located into the well, the well fluid enters the chamber through port 3 in FIG. 7. Well fluid acts on balance piston 5 to urge it into hydraulic oil 9. As temperature and pressure change the balance, piston 5 will oscillate to allow expansion of the oil in the otherwise closed chamber, thus equalizing pressure.

Fluid is moved from reservoir 60 to pump 62 where it is pressurized into accumulator 64. Then upon actuation of spool valve 10 by a command from a downhole controller or an uphole controller the fluid is directed to its target chamber and the operation of shifting the flow control device proceeds as discussed above. It will also be appreciated that accumulator 64 allows pump 62 to be run without any pressure difference to the spool valve or piston cambers. Moreover, the accumulator remains charged with pressure until it is released via the spool valve. This is not to say however that accumulator 64 is critical to the operation of the invention. It is clearly possible to eliminate accumulator 64 and simply allow pressure to oscillate slightly in the piston chamber as the pump works or to employ a stepper motor pump which will step the pressure into the target chamber. A stepper motor is particularly useful where metered operation of the flow control device is desired since the counts of the motor can be employed to provide proportional control and to communicate the position of the closing sleeve to the surface. Moreover, position sensors are extremely helpful in providing information about where the closing sleeve is. This information can be used uphole or downhole as desired.

It is important to note that while control can be maintained without downhole intelligence, intelligent sensor arrangements, i.e., microprocessors (illustrated in FIG. 6 as 70), position sensors (one or more sensors collectively shown as 76 in FIG. 12) for communicating to the microprocessor downhole (or even to the surface if surface controlled), telemetry devices, power regulators, etc. are beneficial to the system described in both embodiments. Thus the downhole intelligence systems described in U.S. Ser. No. 08/385,992 filed Feb. 9, 1995 by Baker Oil Tools and incorporated herein by reference are desirable to monitor conditions including position of the closing sleeve. It will be appreciated that the tools described herein are analogous to the downhole control devices referred to in the incorporated application. By monitoring conditions downhole, metered adjustments of the flow control device can be made to boost efficiency and production of any given well.

It is also important to understand that any one or more of the components of each of these embodiments can be moved to the surface. The only part of the invention necessary to be downhole is the piston arrangement. Other components may be more desirably on the surface to render repair more simple and cost effective.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A downhole tool actuation device comprising:

a) a housing having a spool valve mounted therein, said spool valve having at least one inlet and at least two operation outlets;

b) a fluid source and a pressure source for the fluid, in fluid communication with said inlet;

c) a two-way piston system having a single piston and a chamber bifurcated by said piston which creates two subchambers within said housing, said two subchambers each being associated with one of said two operation outlets; and d) a connector adapted to transfer movement from said piston to a downhole tool attached to said housing.

2. A downhole tool actuation device as claimed in claim 1 wherein said spool valve selectively operably connects said at least one inlet with at least one of said two operation outlets.

3. A downhole tool actuation device as claimed in claim 1 wherein said spool valve further includes at least one winding associated with the interconnection of said at least one inlet with each of said two operation outlets.

4. A downhole tool actuation device as claimed in claim 3 wherein said at least one winding is at least two windings wherein one of said two windings is associated with each of said two operation outlets, said two windings individually positioning said spool valve to connect said inlet to one of said two operation outlets.

5. A downhole tool actuation device as claimed in claim 1 wherein said spool valve further includes a pass through line wherein hydraulic fluid is passed through said spool valve without being delivered to either of said two operation outlets.

6. A downhole tool actuation device as claimed in claim 1 wherein said connector is shearable to restore conventional shiftability of said downhole tool.

7. A downhole tool actuation device as claimed in claim 1 wherein said two subchambers are associated with said two operation outlets by hydraulic lines whereby pressure directed to one of said two operation outlets moves the piston in a direction to close the downhole tool and pressure directed to the other of said two operation outlets moves the piston in a direction to open the downhole tool.

8. A downhole tool actuation device as claimed in claim 1 wherein said inlet is supplied with hydraulic fluid from a downhole pump and accumulator system.

9. A downhole tool actuation device as claimed in claim 1 wherein said inlet is supplied with a hydraulic fluid from a surface location.

10. A downhole tool actuation device as claimed in claim 1 wherein said spool valve further includes a bleed line for bleeding pressure off either of the two subchambers upon pressurization of the other.

11. A downhole tool actuation device as claimed in claim 7 wherein said device is fluid lockable to maintain the piston in any desired position by preventing fluid movement in the two operation outlet lines.

12. A downhole tool actuation device as claimed in claim 1 wherein said downhole tool is variably actuatable by said actuation device.

13. A computer controlled downhole tool actuation device comprising:

a) a housing having a spool valve mounted thereon, said spool valve having at least one inlet and at least two operation outlets;

b) a fluid source and a pressure source for the fluid, in fluid communication with said inlet;

c) a two-way piston system having a single piston and a chamber bifurcated by said piston which creates two subchambers within said housing, said two subchambers each being associated with one of said two operation outlets;

d) a connector adapted to transfer movement from said piston to a downhole tool attached to said housing; and e) a downhole processor and at least one sensor connected thereto, said processor being also connected to said spool valve.

14. A computer controlled downhole tool actuation device as claimed in claim 13 wherein at least one sensor is a plurality of sensors.

15. A computer controlled downhole tool actuation device as claimed in claim 13 wherein said at least one sensor is a position sensor.

16. A computer controlled downhole tool actuation device as claimed in claim 13 wherein said processor is further associated with a telemetry device capable of communication between itself and at least one of a surface location, another zone and another well.

17. A computer controlled downhole tool actuation device as claimed in claim 13 wherein said processor is powered from a surface location.

18. A computer controlled downhole tool actuation device as claimed in claim 13 wherein said processor is powered from a downhole location.

* * * * *